United States Patent [19]

Marker

[11] 4,073,254

[45] Feb. 14, 1978

[54] SAILING MAST FOR SAILING BOARDS

[76] Inventor: Hannes Marker, Hauptstrasse 51-53, 81 Garmisch-Partenkirchen, Germany

[21] Appl. No.: 702,084

[22] Filed: July 2, 1976

[30] Foreign Application Priority Data

July 4, 1975 Germany ..... 2530020

[51] Int. Cl.[2] ..... B63B 15/02

[52] U.S. Cl. ..... 114/90; 114/39

[58] Field of Search ..... 114/90, 91, 39; 343/715, 888, 900

[56] References Cited

U.S. PATENT DOCUMENTS

| | | | |
|---|---|---|---|
| 2,546,026 | 3/1951 | Coon | 343/900 X |
| 2,558,763 | 7/1951 | Lee | 343/888 X |
| 3,312,020 | 4/1967 | Schuster | 114/90 X |
| 3,487,800 | 1/1970 | Schweitzer et al. | 114/91 X |

FOREIGN PATENT DOCUMENTS

| | | | |
|---|---|---|---|
| 1,014,545 | 8/1952 | France | 114/91 |

*Primary Examiner*—Robert B. Reeves
*Assistant Examiner*—Edward M. Wacyra
*Attorney, Agent, or Firm*—Fleit & Jacobson

[57] ABSTRACT

In a sailing board having a tiltable and rotatable mast which is held by the user during sailing and is supported on the board by a base fitting, a lower portion of the mast adjoining the base fitting is flexible and is bridged by a resilient mounting.

5 Claims, 3 Drawing Figures

SAILING MAST FOR SAILING BOARDS

The present invention relates to a sailing mast for sailing boards, which mast is supported on the board with the interpositioning of a mast foot and can be tilted and rotated during sailing by the person holding same.

In such a sailing mast, which is known in various constructions, its tiltability and rotatability is achieved in that its mast foot comprises a joint with three pivots. Two of these pivots intersect at right-angles and extend radially to the sailing mast whilst the third pivot is coaxial with the sailing mast.

When using the sailing boards during so-called wind surfing, it has been found that there is a certain danger of injury to beginners and unskilled users in so far that when the sailing mast intersects a leg of the user and moves downwardly unintentionally, it can strike the leg or foot of the user and injure or even break same because during such critical moments the unprepared user is not always in a position to move his leg out of the danger zone, i.e. out of the line of fall of the sailing mast.

The purpose of the present invention is therefore to avoid this risk of injury.

According to the invention, it is for this reason suggested that the lower portion of the mast connected to the mast foot be flexible and that a resilient mounting be provided to bridge said portion.

In this way one not only avoids the aforementioned risk of injury but also simplifies the foot of the mast because it now need comprise only the pivot that is disposed coaxially with the sailing mast. The two other pivots can be omitted because the flexible mast portion assumes their functions. It is now no longer possible for the sailing mast to bend at a sharp angle closely above the sailing board and therefore the leg or foot of the user can no longer be engaged and injured as previously mentioned.

A preferred embodiment of the sailing mast according to the invention provides for the flexible portion to consist of a row of superposed annular discs of which the apertures define a passage and which converge towards the outside, and for a rope serving as the mounting to extend through the passage and be connected to the adjoining mast portion on the one hand and to the mast foot on the other hand.

For this purpose the rope may consist of elastic material. However, it is just as good if the rope consists of substantially inelastic material, extends with its upper end into the mast which is hollow at least at its connecting region and carries at this end a nipple, and if between the nipple and a closure member, which is normally rigidly connected to the mast and through which the rope enters the mast, there is provided a helical compression spring placed over the rope. To permit the strength of the resilient mounting to be varied, the helical compression spring is supported on the nipple by way of a nut.

To avoid mutual displacement of the annular discs over one another, they may comprise a central projection on one side and a complementary central recess on the other to provide for positive interengagement.

In another embodiment of the sailimg mast according to the invention, the flexible portion is constituted by a coiled helical tension spring which is wound with the turns in contact and also serves as a resilient mounting. In this case, in order to prevent mutual displacement of the helical convolutions over one another during tilting of the sailing mast, the interior of the helical tension spring may be filled with a flexible filling mass.

Two examples of the invention will now be described with reference to the accompanying drawings, wherein.

Figure 1:
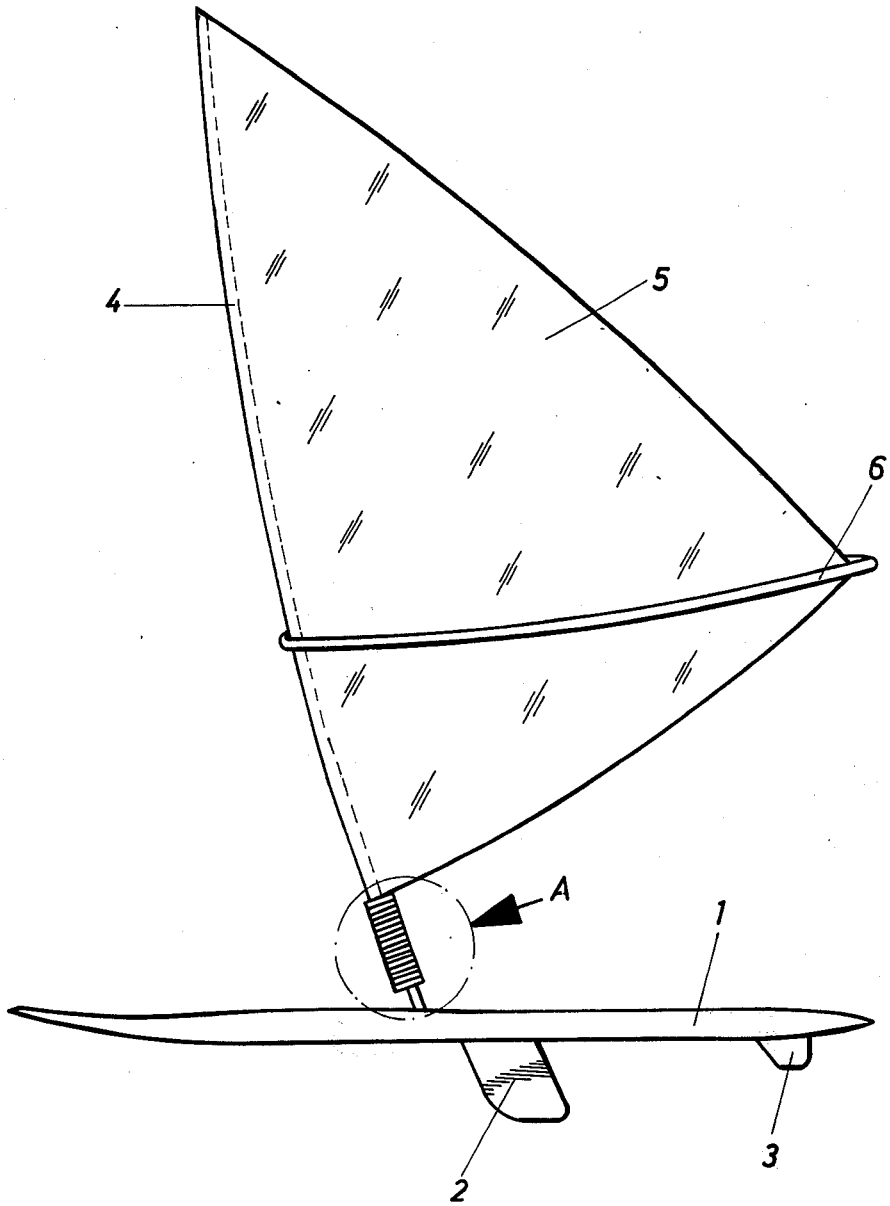
FIG. 1 shows a complete sailing board in side elevation.

Referring to FIG. 1, the sailing board is designated 1. It possesses a drop-keel 2 and a fin 3. Further, the board carries a mast 4 which, in turn, carries a sail 5 and a main boom 6. A user of the sailing board stands on its surface, to the right-hand side of the connecting point for the mast as viewed in FIG. 1, and holds the main boom and thus the sailing mast.

Figure 2:
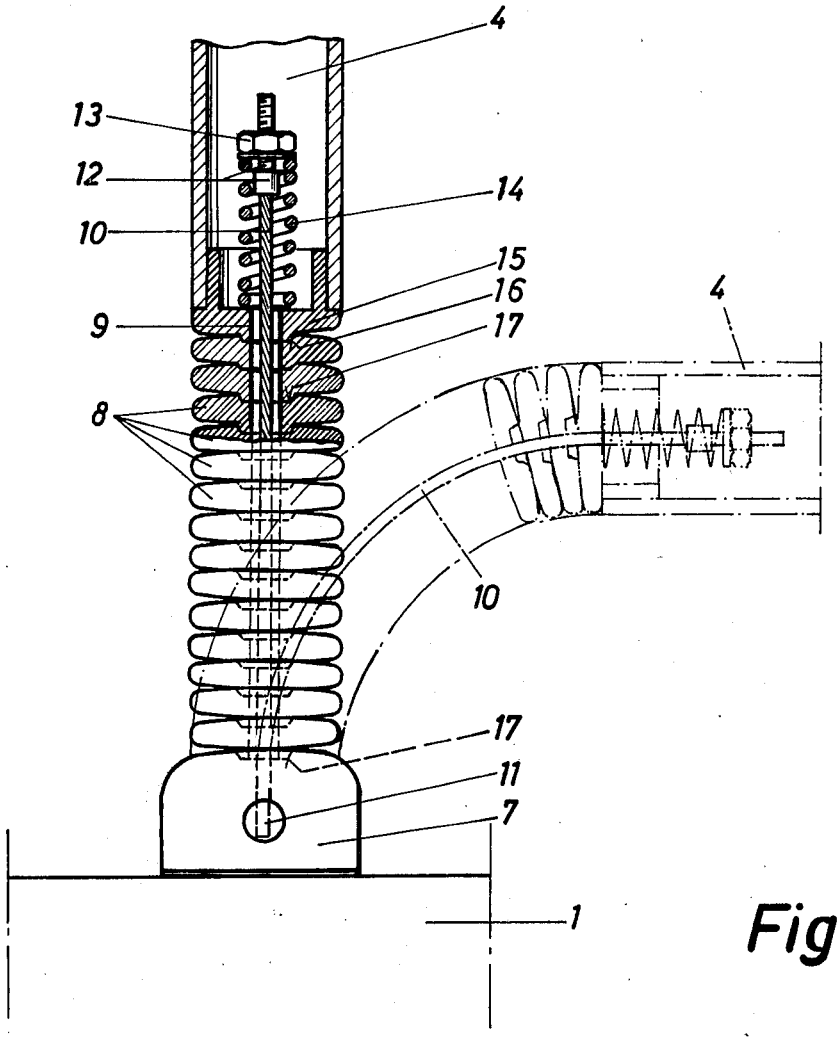
FIG. 2 is a part-sectional enlargement of the point A in FIG. 1.

The sailing mast 4 is supported on the sailing board 1 by way of a mast foot 7 (FIG. 2). The upper portion of the mast foot is, relatively to the lower portion which is releasably anchored to the sailing board, rotatable about an axis coaxial with the mast axis, whereby the sailing mast can be turned about its longitudinal axis. On the upper portion of the mast foot 7 there is disposed a row of annular discs 8 of which the apertures form a passage 9. Extending through this passage there is a rpoe 10 which is anchored at the bottom at 11 in the mast foot 7. At the top it projects into the sailing mast 4 which is hollow in this region, and at its free end it carries a nipple 12 which is provided with an external screwthread and carries a screwthreaded nut 13. This nut forms a counterbearing for a helical compression spring 14 of which the other end is supported by a closure member 15 which covers the lower open end of the upper portion of the sailing mast 4 and by way of which this upper portion is supported on the uppermost annular disc 8. The connection between the upper mast portion and the closure member 15 is releasable so that the nut 13 is accessible, whereby to vary the pretension of the helical compression spring 14 for the purpose of altering the strength of the resilient mounting. In this case, the rope 10 consists of substantially inelastic material.

The annular discs 8 converge towards the outside, whereby the mast can be swung towards all sides. To avoid mutual displacement of the annular discs over one another, the latter are positively interengaged by means of a central projection 16 on their undersides and a complementary central recess 17 in their top surfaces. For the purpose of engaging in this recess of the uppermost annular disc 8, the closure member 15 also possesses a corresponding projection 16. In addition, the upper portion of the mast foot 7 contains a central recess for engagement by the projection of the lowermost annular disc 8.

By reason of the articulation of the sailing mast 4 permitted by the annular discs 8 and by reason of the two-part construction of the mast foot 7, the user can tilt and turn the sailing mast 4 during sailing to suit particular requirements. The tiltability of the sailing mast 4 achieved by means of the invention prevents it from bending at a sharp angle closely above the sailing board 1 and thus there is no longer the danger that the user of the sailing board can wedge a leg or a foot between the sailing mast and the sailing board. In FIG. 2, the sailing mast is illustrated in a deflected position in chain-dotted lines.

Figure 3:
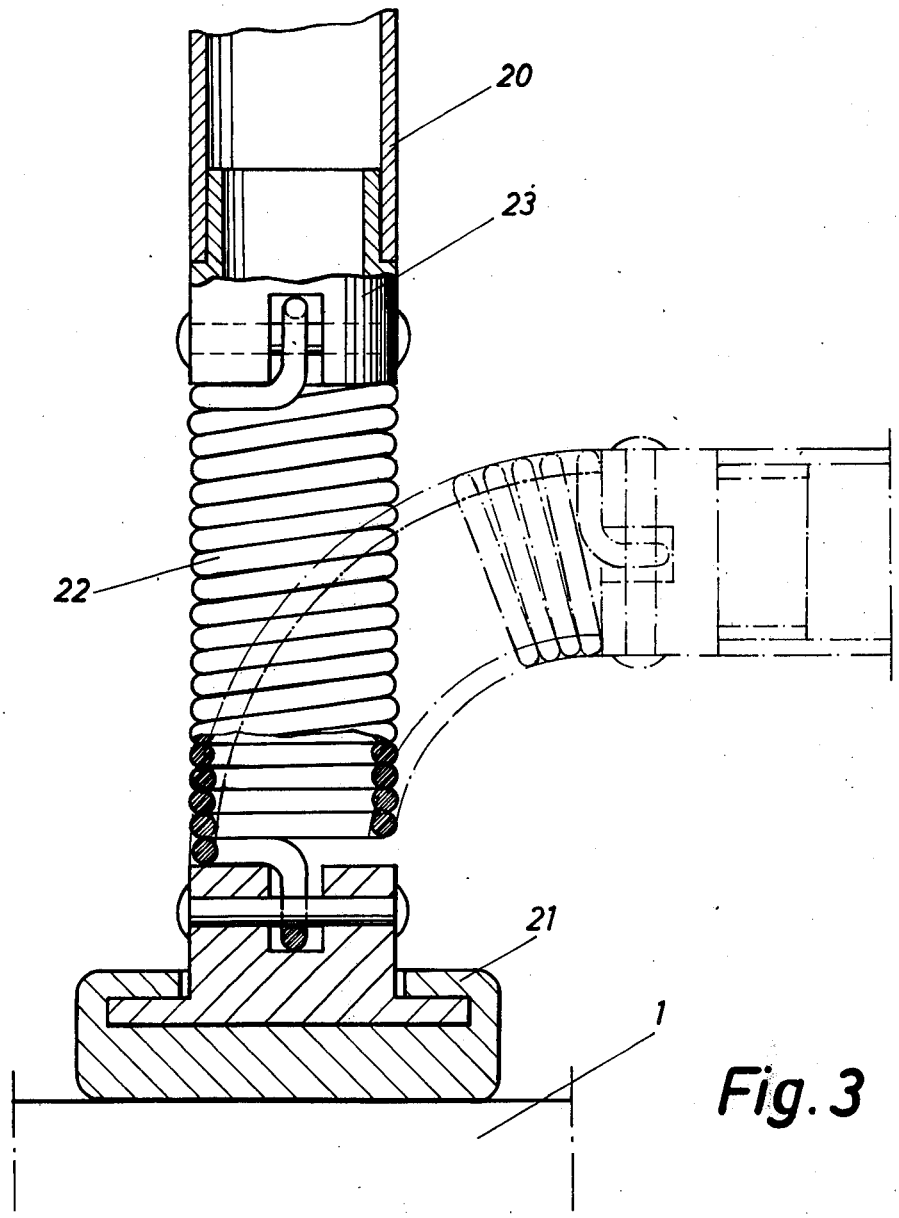
FIG. 3 is a view similar to FIG. 2 of a second embodiment.

FIG. 3 is a representation corresponding to that of FIG. 2 of a second embodiment of a sailing mast according to the invention, here designated 20. It is supported on the sailing board 1 by means of a mast foot 21. The mast foot again consists of two parts, the upper part being rotatable relatively to the lower part about an axis coaxial with the mast axis. Instead of annular discs, this embodiment utilises a coiled helical tension spring 22 which has been wound so that its convolutions touch and which also serves as a resilient mounting. The upper end of the spring is connected to a closure member 23 of the upper portion of the sailing mast 20 whilst its lower end is anchored to the upper portion of the mast foot 21. Thus, the tiltability and rotatability of the sailing mast 20 is achieved in the same manner as in the first embodiment. In the present case, in order to prevent mutual displacement of the helical convolutions on one another during tilting of the sailing mast, the interior of the helical tension spring 22 is filled with a flexible filling mass.

The danger of injury to the user of the sailing board is avoided as it is in the first embodiment. A deflected position of the sailing mast 20 is again indicated in chain-dotted lines.

I claim:

1. A sailing mast for sailing boards which can be manually tilted and rotated during sailing, comprising a mast having a flexible lower portion, support means for supporting said mast on the sailing board comprising a mast foot, a resilient mounting means for interconnecting said mast to said mast foot, wherein said flexible lower portion comprises a row of superposed annular discs wherein the apertures of said discs define a passage, and wherein said discs converge towards the outside, said resilient mounting means comprises a rope, said rope extending through the passage and connected to the adjoining mast portion at its one end and to the mast foot at its other end.

2. A sailing mast according to claim 1, wherein said rope comprises an elastic material.

3. A sailing mast according to claim 1, wherein said mast is hollow at the portion adjoining said flexible lower portion and wherein said rope comprises a substantially inelastic material, the upper end of said rope extending into the mast hollow portion and carrying a nipple, a closure member rigidly connected to the mast through which the rope enters the hollow portion of said mast, and a helical compression spring surrounding the rope.

4. A sailing mast according to claim 3, wherein said helical compression spring is supported on the nipple by a nut.

5. A sailing mast according to claim 1, wherein said annular discs comprise a central projection on one side and a complementary central recess on the other side to provide for positive interengagement.

* * * * *